US010852686B2

(12) United States Patent
Kanazawa et al.

(10) Patent No.: US 10,852,686 B2
(45) Date of Patent: Dec. 1, 2020

(54) CLEANING DEVICE FOR IMAGE BEARING MEMBER, PROCESS CARTRIDGE AND IMAGE FORMING APPARATUS

(71) Applicant: CANON KABUSHIKI KAISHA, Tokyo (JP)

(72) Inventors: Takayuki Kanazawa, Yokohama (JP); Shuhei Tokiwa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/715,147

(22) Filed: Dec. 16, 2019

(65) Prior Publication Data

US 2020/0201237 A1 Jun. 25, 2020

(30) Foreign Application Priority Data

Dec. 21, 2018 (JP) ..... 2018-240047

(51) Int. Cl.
*G03G 21/00* (2006.01)

(52) U.S. Cl.
CPC ..... *G03G 21/0011* (2013.01)

(58) Field of Classification Search
CPC ..... G03G 21/0011; G03G 21/0017
USPC ..... 399/350
See application file for complete search history.

(56) References Cited

U.S. PATENT DOCUMENTS

| | | | | |
|---|---|---|---|---|
| 7,593,670 | B2 | 9/2009 | Matsuda | |
| 7,599,644 | B2 * | 10/2009 | Kawata | G03G 21/0011 399/350 |
| 2003/0035668 | A1 | 2/2003 | Endo | |
| 2008/0075500 | A1 | 3/2008 | Kawata | |
| 2014/0193185 | A1 | 7/2014 | Kami | |

FOREIGN PATENT DOCUMENTS

| | | | |
|---|---|---|---|
| CN | 101174109 | A | 5/2008 |
| JP | H1138848 | A | 2/1999 |
| JP | 2006268021 | A | 10/2006 |
| JP | 2010122468 | A | 6/2010 |

OTHER PUBLICATIONS

Written Opinion and Search Report issued in Singaporean Appln. No. 10201912539W dated Sep. 29, 2020.

* cited by examiner

*Primary Examiner* — William J Royer
(74) *Attorney, Agent, or Firm* — Rossi, Kimms & McDowell LLP

(57) ABSTRACT

A cleaning device has: a cleaning frame; a cleaning member which, after transfer through contact with an image bearing member, removes a developer remaining on the image bearing member; and a sheet member having flexibility and coming into contact with the image bearing member at an upstream side of a contact position between the cleaning member and the image bearing member in the rotation direction of the image bearing member. An external additive is an inorganic salt having a charging polarity on the positive side with respect to the developer, and work functions Φ(S), Φ(A), Φ(T) of the sheet member, the external additive and the developer satisfy $0 \leq |\Phi(A)-\Phi(S)| < 0.57$; and $\Phi(A) < \Phi(T)$.

10 Claims, 16 Drawing Sheets

FIG. 8 (CONVENTIONAL)
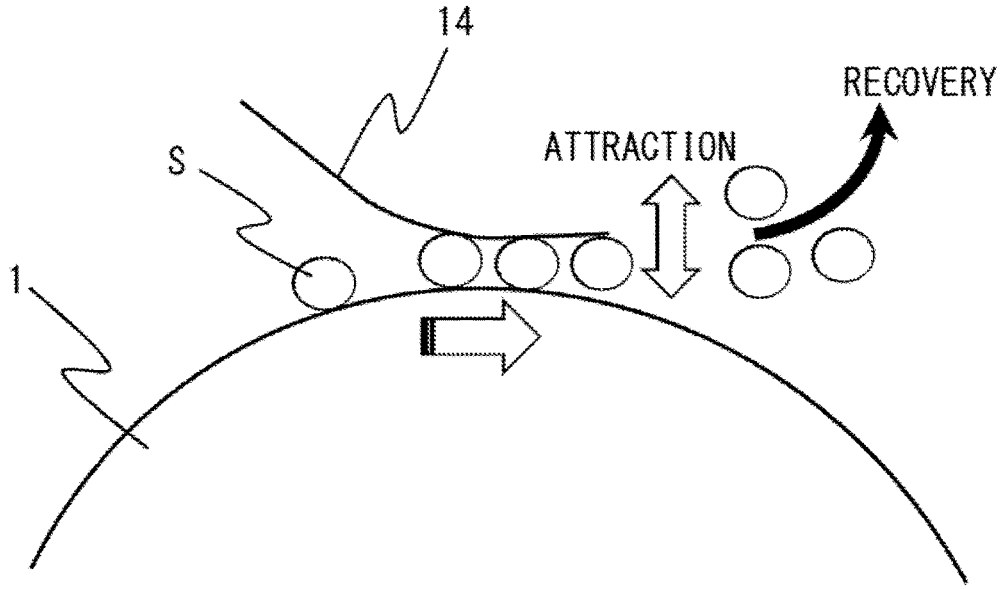

CLEANING DEVICE FOR IMAGE BEARING MEMBER, PROCESS CARTRIDGE AND IMAGE FORMING APPARATUS

BACKGROUND OF THE INVENTION

Field of the Invention

The present invention relates to an image forming apparatus, such as a printer or copier, or a multifunction machine that combines the functions of the foregoing, which is utilized in an electrophotographic system or an electrostatic recording system, and relates to a cleaning device and to a process cartridge that are utilized in the image forming apparatus.

Description of the Related Art

Cleaning Scheme

A cleaning process of developer in a general image forming apparatus will be explained next. Cleaning schemes used in a cleaning process include a scheme in which with a view to removing, from an image bearing member, residual developer remaining after transfer and developer not having been transferred for instance on account of a paper jam during passing of paper, a blade is brought into contact with the image bearing member, to thereby scrape developer off the image bearing member. In this scheme, the developer is removed in accordance with a physical method, and hence the scheme is widely resorted to since it can be realized in inexpensive configurations, while affording good cleaning performance.

Faulty Cleaning Faulty cleaning is one problem of cleaning schemes that utilize a blade.

Faulty cleaning is a phenomenon whereby developer slips by the blade without being removed by the blade. Instances of faulty cleaning include occurrence of vibration in the blade derived from strong frictional forces between the image bearing member and the blade and that are caused by continued rotation of the image bearing member, for instance in the case of printing of an image of low print percentage, or in the case of preliminary rotation in which little developer or little external additive of the developer is supplied. Vibration of the blade is also referred to as chatter.

Chatter Mechanism

The occurrence of such chatter will be explained next. A pool (about 8 μm) of developer and a pool (several nm to several hundred of nm) of external additive become formed at the tip of the blade as cleaning of the developer is repeated. The external additive is added to the developer for the purpose of, for instance, imparting flowability, controlling charging for example through adjustment of charge, and assisting cleaning. Microscopically, a nip portion formed between the blade and the image bearing member, through contact of the blade with the image bearing member, is occupied by external additive having a particle size smaller than that of the developer. The frictional forces between the blade and the image bearing member are kept small thanks to the presence of the external additive at this portion. When the amount of external additive at this portion drops, the frictional forces between the blade and the image bearing member increase, and as a result chatter becomes likelier to occur.

Supply of External Additive

After transfer of the developer from the surface of the image bearing member, the external additive remains alone on the image bearing member, and is supplied in large amounts to the nip portion. Generally, the addition amount of external additive with respect to the developer is raised in order to increase the supply amount of external additive to the nip portion. The external additive includes also some external additive which, adhered to the surface of the developer remaining on the image bearing member after transfer, reaches the nip portion along with the developer, and is removed from the image bearing member together with the developer in a cleaning process. Accordingly, there are techniques, as disclosed in Japanese Patent Application Publication No. 2010-122468, wherein an external additive is supplied to the nip portion by forcibly performing a printing process.

SUMMARY OF THE INVENTION

Process speeds have become higher in recent years, and thus the influence of blade chatter on image formation can no longer be ignored, while also the requirements on developer cleaning performance have become more exacting. However, the efficiency of supply of external additive to the nip portion formed between a cleaning member and the image bearing member cannot be considered to be sufficient as yet.

It is an object of the present invention, arrived at in the light of the above considerations, to suppress chatter, and thereby enhance cleaning performance, by increasing the supply efficiency of external additive to a nip portion formed between a cleaning member and an image bearing member.

With a view to attaining the above goal, a cleaning device of the present invention has:

a cleaning frame;

a cleaning member having one end attached to the cleaning frame and the other end that is a free end, the cleaning member coming into contact with an image bearing member so as to remove developer remaining on the image bearing member after transfer of a developer image from the image bearing member, the image bearing member being capable of rotating and bearing a developer image which is formed of a developer containing an external additive; and a sheet member having flexibility, and having one end attached to the cleaning frame and the other end that comes into contact with the image bearing member at an upstream side of a contact position between the cleaning member and the image bearing member in the rotation direction of the image bearing member, wherein the external additive is an inorganic salt having a charging polarity on the positive side with respect to the developer; and wherein a work function Φ(S) of the sheet member, a work function Φ(A) of the external additive and a work function Φ(T) of the developer satisfy Expressions (1) and (2):

$$0\ (\text{eV}) \leq |\Phi(A)-\Phi(S)| < 0.57\ (\text{eV}) \quad (1)$$

$$\Phi(A) < \Phi(T) \quad (2)$$

With a view to attaining the above goal, moreover, a process cartridge device of the present invention has:

an image bearing member capable of rotating and bearing a developer image which is formed of a developer containing an external additive;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member; and a sheet member having flexibility, and having one end attached to the cleaning frame and the other end that comes into contact with the image bearing member at an upstream side of a contact position between the cleaning member and the image bearing member in the rotation direction of the image bearing member, wherein the external additive is an inorganic salt having a charging polarity on the positive side with respect to the developer; and wherein a work function Φ(S) of the sheet member, a work function Φ(A) of the external additive and a work function Φ(T) of the developer satisfy Expressions (3) and (4):

$$0\ (\text{eV}) \leq \Phi(A) - \Phi(S) | < 0.57\ (\text{eV}) \quad (3)$$

$$\Phi(A) < \Phi(T) \quad (4)$$

With a view to attaining the above goal, moreover, an image forming apparatus of the present invention has:

an image bearing member capable of rotating and bearing a developer image which is formed of a developer containing an external additive;

a transfer member that transfers the developer image borne on the image bearing member to a transferring material;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member; and a sheet member having flexibility, and having one end attached to the cleaning frame and the other end that comes into contact with the image bearing member at an upstream side of a contact position between the cleaning member and the image bearing member in the rotation direction of the image bearing member, wherein the external additive is an inorganic salt having a charging polarity on the positive side with respect to the developer;

and wherein a work function Φ(S) of the sheet member, a work function Φ(A) of the external additive and a work function Φ(T) of the developer satisfy Expressions (5) and (6):

$$0\ (\text{eV}) \leq |\Phi(A) - \Phi(S)| < 0.57\ (\text{eV}) \quad (5)$$

$$\Phi(A) < \Phi(T) \quad (6)$$

The image forming apparatus according to the present invention affords good cleaning performance through efficient supply of an external additive to a nip portion formed between a cleaning member and an image bearing member.

Further features of the present invention will become apparent from the following description of exemplary embodiments with reference to the attached drawings.

BRIEF DESCRIPTION OF THE DRAWINGS

FIG. 8 is a cross-sectional diagram of an external additive and a recovery sheet member according to a conventional example;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

Figure 2:
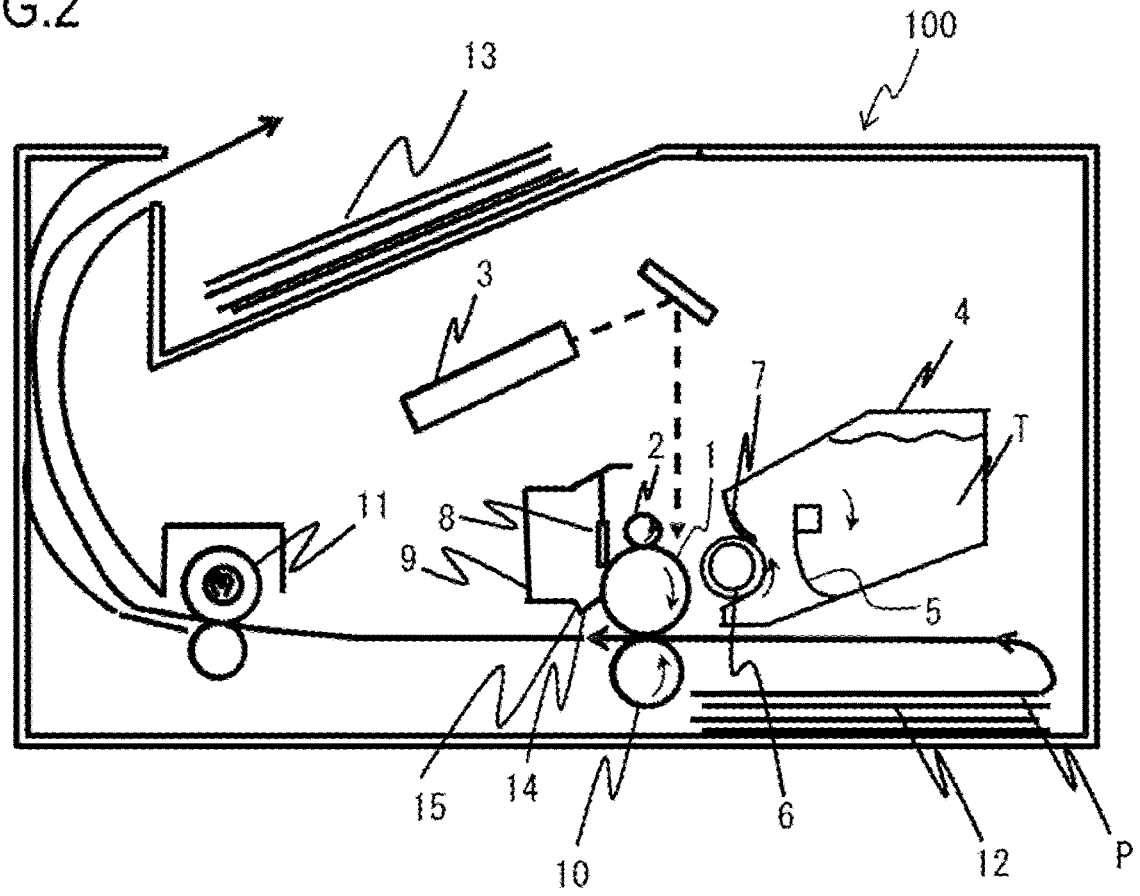
FIG. 2 is an image forming apparatus according to Examples 1, 2 and 3.

Example 1 of the present invention will be explained next. An electrophotographic image forming apparatus provided with a fixing apparatus (hereafter image forming apparatus) according to Example 1 will be explained first. FIG. 2 is a cross-sectional schematic diagram of an image forming apparatus 100 of Example 1.

Image Forming Apparatus

An image forming process performed in an image forming apparatus 100 according to the present example will be explained next, together with various members disposed within the apparatus as illustrated in FIG. 2. A sheet P of paper or the like as a transferring material is transported by a transport roller (not shown), from a sheet cassette 12 of the image forming apparatus 100. In synchrony with this sheet transport, a photosensitive drum 1 which is a rotatable image bearing member is charged by a charging roller 2 which is a rotatable charging member. Thereafter, the photosensitive drum 1 is exposed by an exposure device 3, to thereby form an electrostatic latent image on the photosensitive drum 1. The photosensitive drum 1 and the charging roller 2 rotate in the directions of the arrows in the figure. In the exposure device 3, a laser beam is reflected by a polygon mirror, to expose the surface of the photosensitive drum 1 in a main scanning direction and a sub-scanning direction.

A magnetic single-component developer T is supplied, by a stirring member 5, from a developer accommodating chamber 4 to the vicinity of a developing sleeve 6 which is a developer carrier. The developing sleeve 6 is a hollow cylindrical rotating member and has, in the interior thereof, a magnet roller (not shown) which is a transport member. The developer T is borne and transported on the surface of the developing sleeve 6 by the magnetic force of the magnet roller. A thin layer of a desired amount of the developer T is caused to be borne on the surface of the developing sleeve 6 by a developing blade 7.

Next, developing bias is applied to the developing sleeve 6, as a result of which the developer T is supplied to the photosensitive drum 1, and a developer image according to the latent image is developed on the photosensitive drum 1. The developer image is transferred to the transported sheet P through application of bias to a transfer roller 10 as a transfer member. The sheet P having the developer image transferred thereonto is transported to a fixing apparatus 11, where the developer image is fixed to the sheet P, after which the sheet P is discharged to a paper output unit 13, at the top of the image forming apparatus 100, by a paper output roller (not shown).

Herein developer after transfer is over remains on the photosensitive drum 1. The remaining developer is removed by a cleaning blade 8, having elasticity, as a cleaning member. One end of the cleaning blade 8 is fixed to a recovery container 9 as an accommodating part in which the cleaned developer is accommodated, the other end of the cleaning blade 8 being a free end. The cleaning blade 8 comes into contact with the photosensitive drum 1 in a state where a free end of the cleaning blade 8 points in a counter-direction of the rotation direction of the photosensitive drum 1. One end of a recovery sheet member 14 as a sheet member that recovers the developer is a fixed end that is fixed to the recovery container 9, and the other end is a free end. The recovery sheet member 14 extends along the rotation direction of the photosensitive drum 1, from the fixed end to the free end. The free end of the recovery sheet member 14 comes into contact with the photosensitive drum 1 in a state where the free end faces in the rotation direction of the photosensitive drum 1. The recovery sheet member 14 has flexibility. The space across which the cleaning blade 8 and the recovery sheet member 14 oppose each other communicates with the recovery container 9; as a result, the developer removed from the photosensitive drum 1 becomes accommodated in the recovery container 9, without leaking out of the recovery container 9 through the gap between the photosensitive drum 1 and a cleaning frame 15.

Developer The developer T used in the present example has a number-average particle diameter of 5 to 8 μm. In the explanation below the developer T is envisaged to be a magnetic developer that has negative charging performance and is produced in accordance with a suspension polymerization method, the developer having a number-average particle diameter of about 8 μm.

A binder resin of the developer T used in the present example is a styrenic resin, and a release agent of the developer T is an ester compound. Ester compounds are moderately compatible with styrenic resins, so that the binder resin is softened thereby, and in addition have also a high so-called sharp melt property; accordingly, ester compounds that are present without intermixing with the styrenic resin melt quickly at a fixing region in the image forming apparatus 100. A crystalline polyester is finely dispersed in the developer T, in order to enhance the low-temperature fixing performance of the developer T.

An inorganic substance can be formed on the surface of the developer T, in order to modify thus the developer T. Formation of an inorganic substance on the surface of the developer T is referred to as external addition, and the inorganic substance is referred to as an external additive. The external additive is inorganic fine particles adhered to the surface of the developer T. In the present example the inorganic substance used as an external additive is an inorganic salt; herein this may be used one single type of inorganic salt, or two or more types of inorganic salts in combination. In the present example spherical strontium titanate having a number-average particle diameter of about 100 nm is used as the external additive. In the present example the external additive is externally added in an amount of 0.5% parts by mass relative to the developer T.

An explanation follows next on the work functions of the developer T and of strontium titanate as the external additive. The details of the work functions will be expounded further on. The work function of the developer T in the present example is 6.03 eV. The work function of strontium titanate used as the external additive in the present example is 5.9 eV. Strontium titanate has a polarity (characteristic) whereby strontium titanate becomes positively charged with respect to the developer T, and can be readily supplied (supplied in large amounts) in the form of stand-alone developer (i.e. in the form of primary particles) to a non-printing section on the photosensitive drum 1. The number-average particle diameter of the primary particles of strontium titanate is about 100 nm; among various substances used as external additives, strontium titanate tends to have a comparatively large number-average particle diameter, and to readily pool up at the tip (nip portion) of the cleaning blade 8. In consequence, strontium titanate is suitable as a lubricant since it can be supplied in large amounts to the nip portion (is likely to afford enhanced supply efficiency), and pools readily up at the nip portion.

Recovery Sheet Member

The recovery sheet member 14 will be explained next. As illustrated in FIG. 2, the recovery sheet member 14 is disposed upstream of the cleaning blade 8, in the rotation direction of the photosensitive drum 1. After transfer of the developer image to the sheet P, the developer remaining on the photosensitive drum 1 is removed by the cleaning blade 8, and becomes thereupon accommodated in the recovery container 9. Leakage of the developer accommodated in the recovery container 9 to the exterior of the recovery container 9 is suppressed by the recovery sheet member 14.

Figure 3:
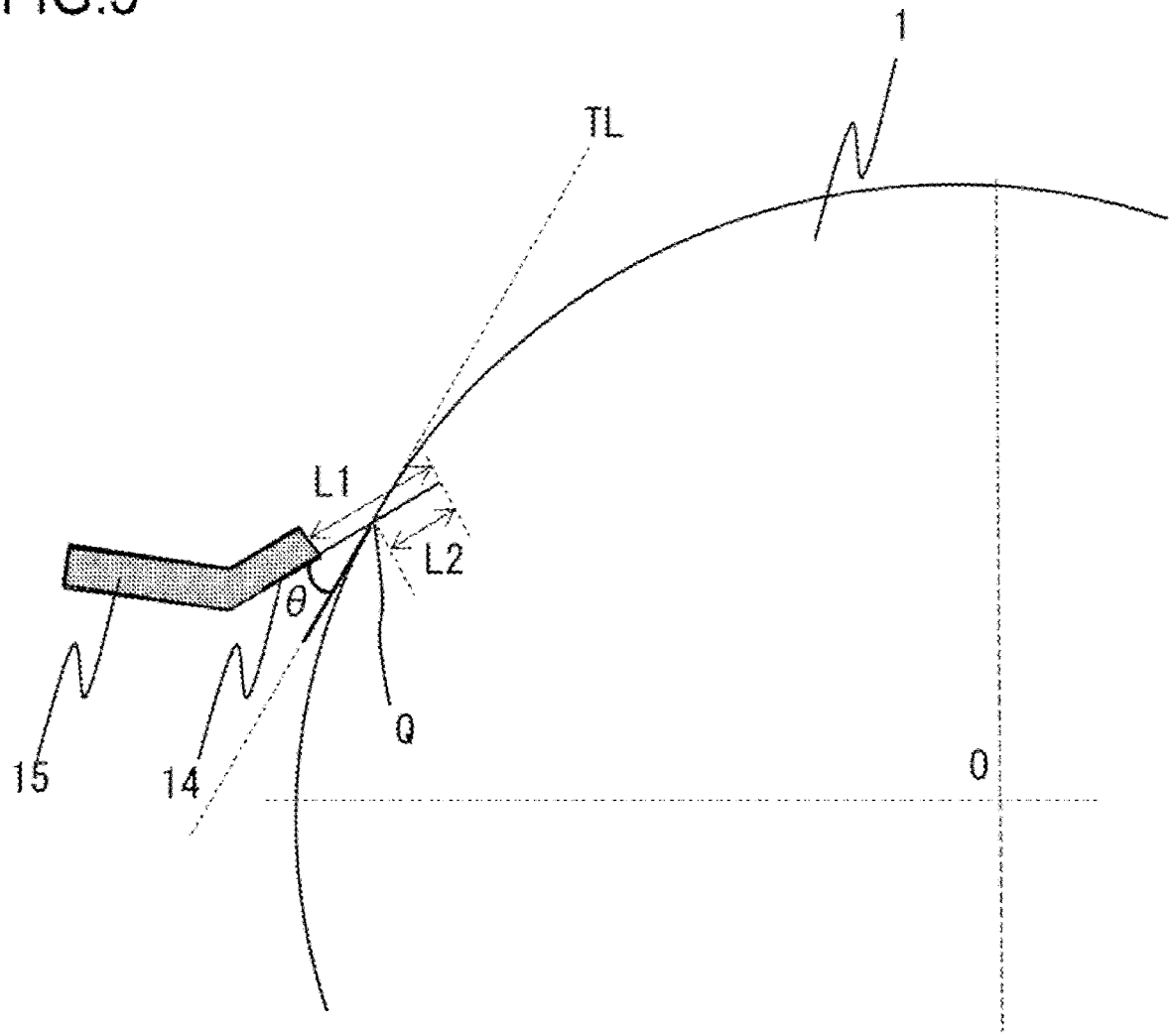
FIG. 3 is a cross-sectional diagram of a recovery sheet member.

As illustrated in FIG. 3, one end of the recovery sheet member 14 in the present example is a fixed end that is joined, for instance by a double-sided tape or by laser welding, to a joining surface provided in the cleaning frame 15 that makes up the recovery container 9. The fixed end of the recovery sheet member 14 is joined to the cleaning frame 15 so as to be into contact with the photosensitive drum 1. More specifically, the other end of the recovery sheet member 14, i.e. the tip, is a free end, in a state where the recovery sheet member 14 is joined to the cleaning frame 15. The portion of the recovery sheet member 14 on the free end side extends from the upstream side towards the downstream side, in the rotation direction of the photosensitive drum 1, and comes into contact with the photosensitive drum 1. Therefore, the direction along which the recovery sheet member 14 extends from the fixed end to the free end is substantially the same direction as the rotation direction of the photosensitive drum 1, at the region at which the free end comes into contact with the photosensitive drum 1. The contact position of the recovery sheet member 14 with the photosensitive drum 1 lies further upstream, in the rotation direction of the photosensitive drum 1, from the contact position of the cleaning blade 8 with the photosensitive drum 1. The recovery sheet member 14 plugs the gap between the photosensitive drum 1 and the cleaning frame 15, so as to prevent the developer accommodated in the recovery container 9 from leaking out through the gap between the photosensitive drum 1 and the cleaning frame 15. A device having the cleaning frame 15, the cleaning blade 8 and the recovery sheet member 14 is an example of a cleaning device. A device having the photosensitive drum 1, the cleaning frame 15, the cleaning blade 8 and the recovery sheet member 14 is an example of a process cartridge.

The characteristics of the material of the recovery sheet member 14 used in the present example are as follows.

Material: PPS (polyphenylene sulfide) sheet
Thickness: 38 μm
Work function: 5.80 eV
Young's modulus: 80 $N/m^2$
Poisson's ratio: 0.38

The recovery sheet member 14 will be explained next with reference to FIG. 3. In the present example, the recovery sheet member 14 is joined to the cleaning frame 15 in such a manner that the recovery sheet member 14 comes into contact with the photosensitive drum 1 while satisfying the conditions below. In the conditions below, the "free length" is a length L1 of the portion of the recovery sheet member 14 not in contact with the cleaning frame 15, in a state where the recovery sheet member 14 is not in contact with the photosensitive drum 1. In a state where the photosensitive drum 1 is absent, the term "penetration level" is a length L2 from an intersection Q at which the recovery sheet member 14 and the surface of the photosensitive drum 1 intersect each other assuming the photosensitive drum 1 is present, up to the free end of the recovery sheet member 14. The "setting angle" is the angle θ between the recovery sheet member 14 and a tangent TL of the photosensitive drum 1 at the intersection Q.

Free length L1: 4.5 mm
Penetration level L2: 2.0 mm
Setting angle θ: 23°

The length of a nip portion 16 formed through contact of the recovery sheet member 14 configured on the basis of the above conditions, and the photosensitive drum 1, i.e. the length of a portion of contact, with the photosensitive drum 1, of the recovery sheet member 14 extending in the rotation direction of the photosensitive drum 1, is 500 μm. The contact pressure on the photosensitive drum 1, exerted by the recovery sheet member 14, is $8.72\times10^{-4}$ N/mm.

Cleaning Blade

The cleaning blade 8 is formed of a support metal plate fixed to the recovery container 9 and a plate-like rubber blade that comes into contact with the photosensitive drum 1. The material of the rubber blade is an elastic rubber such as polyurethane rubber. The cleaning blade 8, which is disposed so as to point in a so-called counter direction with respect to the rotation direction of the photosensitive drum 1, comes into contact with the photosensitive drum 1; as a result, the cleaning blade 8 cleans, specifically removes, the developer remaining on the photosensitive drum 1 after transfer. A desired cleaning effect of the developer on the photosensitive drum 1 by the cleaning blade 8 is obtained through proper setting of the contact angle and contact pressure of the cleaning blade 8 to the photosensitive drum 1. The Wallace hardness of the cleaning blade 8 in the present example is set to 75°, and the thickness is set to 2 mm. The contact angle of the cleaning blade 8 with respect to the photosensitive drum 1, i.e. the angle formed by the cleaning blade 8 and the surface of the photosensitive drum 1, is set to 25°. The contact pressure of the cleaning blade 8 against the photosensitive drum 1 is set to 0.03 N/mm.

If the contact pressure of the cleaning blade 8 against the photosensitive drum 1 is too low, developer may slip between the photosensitive drum 1 and the cleaning blade 8. When by contrast the contact pressure of the cleaning blade 8 against the photosensitive drum 1 is too high, frictional forces between the photosensitive drum 1 and the cleaning blade 8 increase, and chatter and so-called tuck-up of the cleaning blade 8 may occur as a result. When chatter occurs in the cleaning blade 8, a gap arises between the photosensitive drum 1 and the cleaning blade 8 on account of vibration of the cleaning blade 8, and developer may slip through that gap. In consequence, the image formation results exhibit image defects. Tuck-up of the cleaning blade 8 translates into damage to the cleaning blade 8, which may then no longer be able to perform cleaning.

Work Function Measurement

Focusing in the present example on the positional relationship of the materials of the recovery sheet member and an external additive in a charging series (triboelectric series), the recovery sheet member and the developer having the external additive added thereto are evaluated on the basis of work functions thereof measured in accordance with the measurement method below.

The work function (Φ) of a substance, which is the energy (units: eV) required to extract electrons from the substance, allows herein evaluating the charging polarity of the recovery sheet member and the developer. In a case where respective different substances are used in two members, the greater the difference in the work functions of the substances, the greater is the electric field that is generated, on account of triboelectric charging, between the two members. The smaller the difference in the work functions of the substances, the smaller is the electric field that is generated, on account of triboelectric charging, between the two members.

Figure 4A:
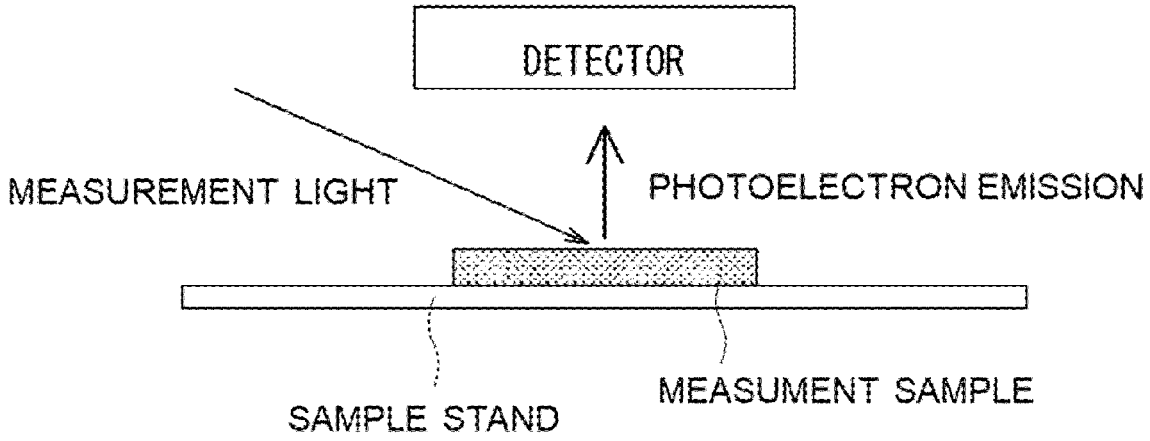
FIG. 4A and FIG. 4B are explanatory diagrams of work function measurement.

A method for measuring work functions will be explained next. As illustrated in FIG. 4A, a substance to be measured (measurement sample) is placed on a sample stand, measurement light is irradiated onto the substance from outside, and photoelectrons emitted by the substance are detected by a detector. The work function is calculated for instance on the basis of the energy of the measurement light and on the basis of the number and the kinetic energy of the detected photoelectrons. In the present example the work function (Φ) is measured using a surface analyzer (AC-2 by Riken Keiki Co., Ltd.). In the present example a deuterium lamp is used in the surface analyzer, with the irradiation light amount of the lamp set as appropriate, and monochromatic light is extracted by a spectrometer and is projected onto the sample. Herein the measurement sample is irradiated with measurement light to a spot size of 4 (mm)×4 (mm), over an energy operation range of 3.4 to 6.2 (eV), and for a measurement time of 10 (sec/1 point).

Photoelectrons emitted from the sample surface are detected by the detector, and are subjected to computing processing by software for work function calculation, built into the surface analyzer, so that the work function of the sample is obtained as a result. The measurement in the surface analyzer is carried out with a repeatability (standard deviation) of 0.02 (eV).

In the measurement of the work functions of the recovery sheet member and of the developer used in the present example, the recovery sheet member and developer that are utilized are in a state prior to image forming. The measurement by the surface analyzer is performed after removal, by air blowing, of foreign matter adhered to the surface of the recovery sheet member. In order to ensure data reproducibility in the measured values, the work function is also measured for a recovery sheet member which, after image forming, has been allowed to stand for 24 hours under conditions of use temperature of 23° C. and humidity of 50% RH.

The measurement light is irradiated onto the sample at a spot of 4 (mm)×4 (mm), according to the above conditions. To measure a sheet-shaped sample such as the recovery sheet member, therefore, a test piece having a size of at least 1 (cm)×1 (cm) is produced and is fixed to a sample stand. In a case where a powdery sample such as a developer is to be measured, the sample is compacted in the form of a pellet that is then fixed to the sample stand.

Figure 4B:
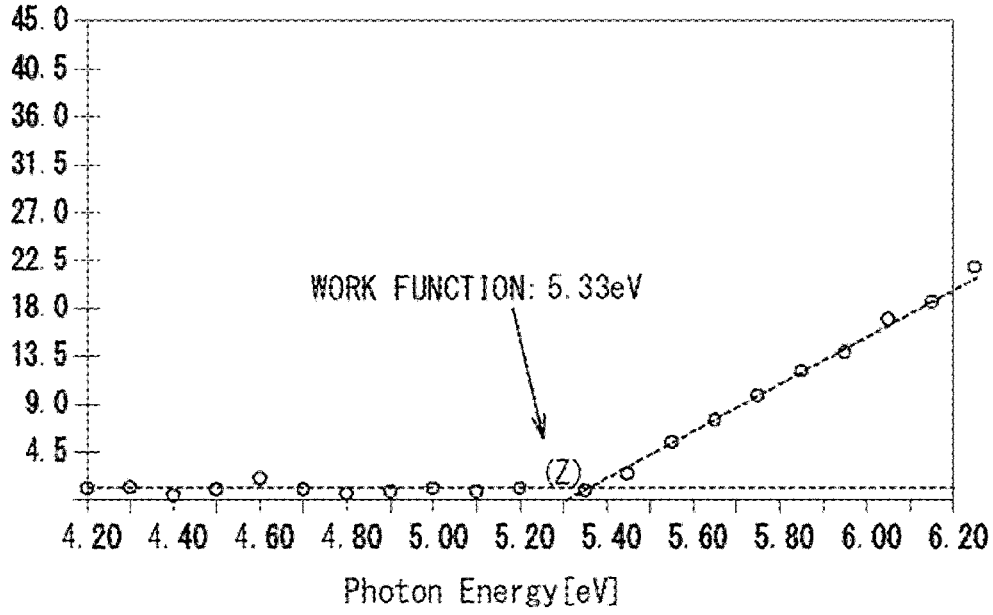

When the excitation energy of monochromatic light with which the sample is scanned in the surface analyzer is caused to rise from low to high, the sample starts emitting photons, from a given energy value; this energy threshold value is taken as the work function. FIG. 4B illustrates a graph of a measurement result of a work function measurement of the recovery sheet member of the present example using the above surface analyzer. In FIG. 4B the measured values are plotted in the form of circles that are then joined by an approximate line (dashed line). The horizontal axis of the graph represents photon energy (eV), and the vertical axis of the graph represents emission yield. In the graph the emission yield is the 0.5th power of photoelectron yield per unit photon. In the graph illustrated in FIG. 4B the work function is the excitation energy at the inflection point ("(Z)" in the figure) of the approximate line. In the example of the graph illustrated in FIG. 4B, for instance, the work function is 5.33 eV.

Measurement of Contact Pressure

The method for calculating the contact pressure of the recovery sheet member 14 against the photosensitive drum 1 will be explained next with reference to FIG. 5.

Figure 5:
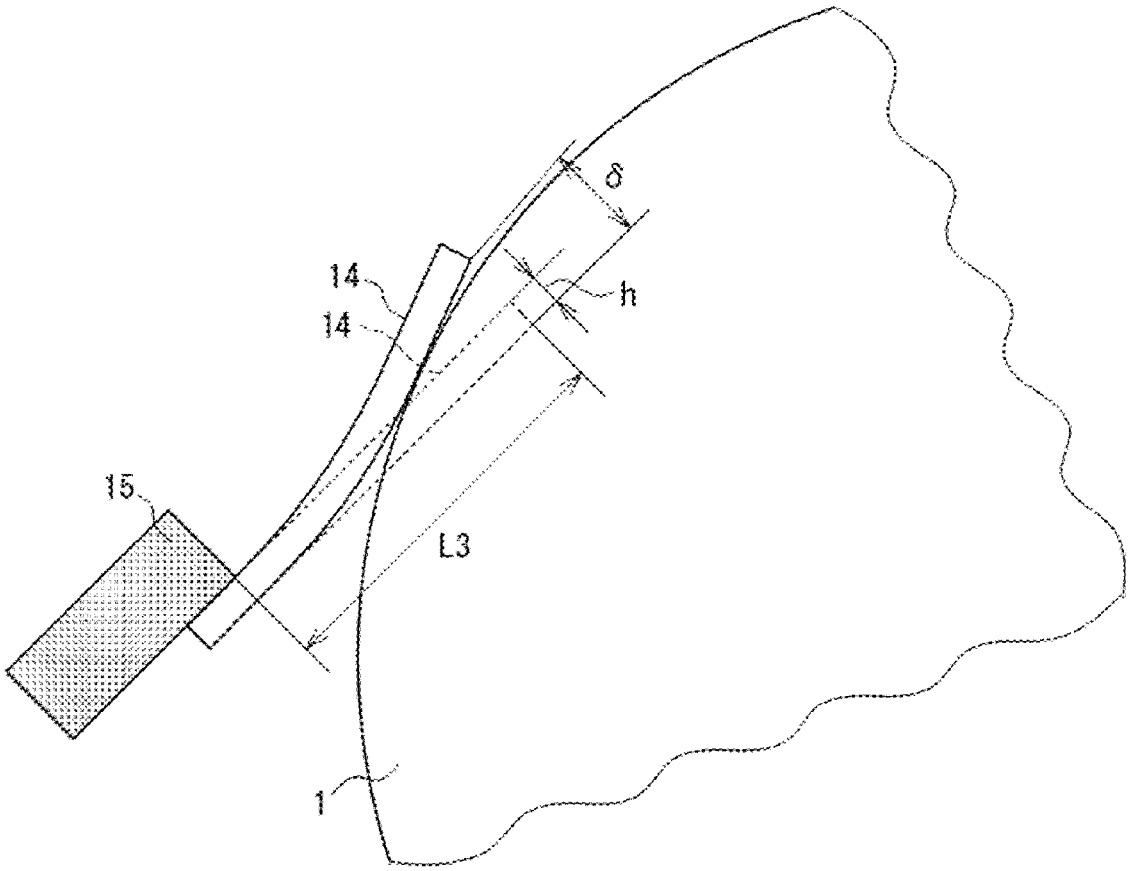
FIG. 5 is an explanatory diagram of a contact pressure measurement.

FIG. 5 illustrates a state in which the recovery sheet member 14 comes into contact with the photosensitive drum 1. As illustrated in FIG. 5, one end of the recovery sheet member 14 is joined and fixed to the cleaning frame 15 of the recovery container 9, while the other end, i.e. the tip which constitutes a free end, comes into contact with the photosensitive drum 1. The recovery sheet member 14 comes into contact with the photosensitive drum 1 in a flexed state.

The recovery sheet member 14 that is used in the image forming apparatus 100 of the present example is a flat plate-shaped member. The contact pressure Pa (N) of the recovery sheet member 14 against the photosensitive drum 1 per unit length (1 mm) in the longitudinal direction is calculated on the basis of Expression (7) below, using a general expression of deflection and load exerted on a cantilever beam.

$$Pa=\delta Eh^3/\{4L3^3(1-\nu^2)\} \quad (7)$$

As illustrated in FIG. 5, herein 6 denotes the deflection amount (mm) of the recovery sheet member 14; L3 denotes the length (mm) from the fixed end of the recovery sheet member 14 up to the upstream side of the nip portion 16 formed through contact with the photosensitive drum 1, and h denotes the thickness (mm) of the recovery sheet member 14. Further, E denotes the Young's modulus (N/mm$^2$) of the recovery sheet member 14 and v denotes the Poisson's ratio of the recovery sheet member 14. In the calculation of the contact pressure Pa, the deflection amount δ and the length L3 of the recovery sheet member 14 are worked out on the basis of an observation of the state in which the recovery sheet member 14 comes into contact with the photosensitive drum 1 when both the recovery sheet member 14 and the photosensitive drum 1 are stationary.

Measurement of Length of Nip Portion 16

Figure 6:
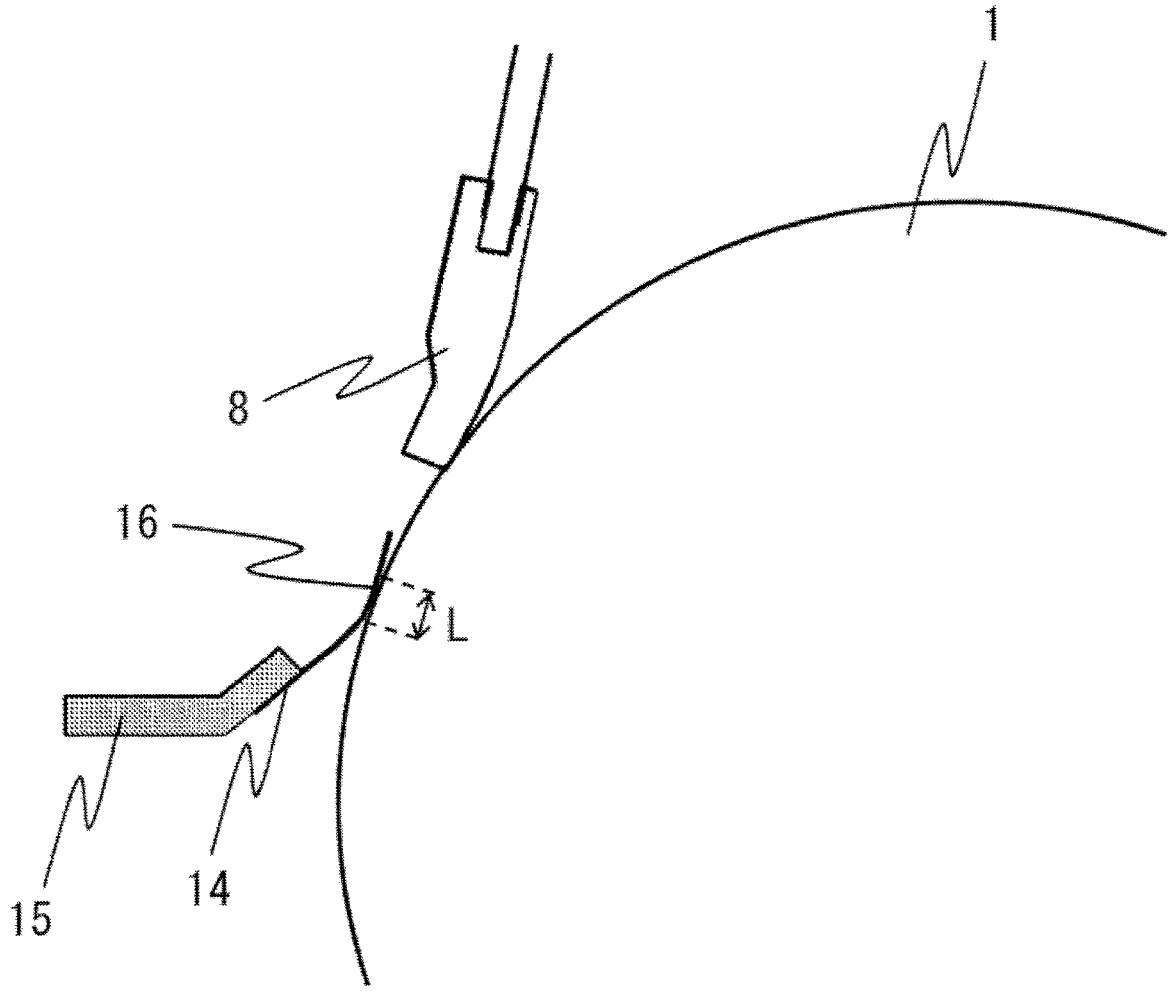
FIG. 6 is an explanatory diagram of a nip portion.

The length L of the nip portion 16 formed through contact of the recovery sheet member 14 against the photosensitive drum 1 is calculated in the manner below, as illustrated in FIG. 6. Image formation is performed using the image forming apparatus 100, in an environment at a temperature of 23° C. and humidity of 50%. As the image to be formed an image is used that has an image ratio of 4% resulting from drawing of a plurality of horizontal lines (lines along the axial direction of the rotation axis of the photosensitive drum 1). Then 1000 prints are outputted continuously using paper of A4 size, in the image forming apparatus 100, and rubbing marks formed on the surface of the recovery sheet member 14 are observed using for instance a microscope. The length L of the nip portion 16 is then calculated on the basis of the change in the tinge of the observed rubbing marks and on the basis of rubbing scratches.

Charge Amount of External Additive

This will be explained with reference to FIG. 7. Particles of an external additive S of strontium titanate have a small positive charge amount with respect to particles of the developer T. The positional relationship of the materials of strontium titanate and the developer in the charging series is such that the developer T has a negative charge amount. In the developing process, as a result, the external additive of the present example becomes supplied as stand-alone external additive, to so-called solid white sections. The external additive in the present example is prone to remain on the photosensitive drum 1 in the transfer process, against the influence of the transfer electric field. It is found that, as a result, the external additive in the present example is an external additive that is readily present standing alone on the surface of the photosensitive drum 1, i.e. is an external additive that is readily supplied to the tip of the cleaning blade 8.

Figure 7:
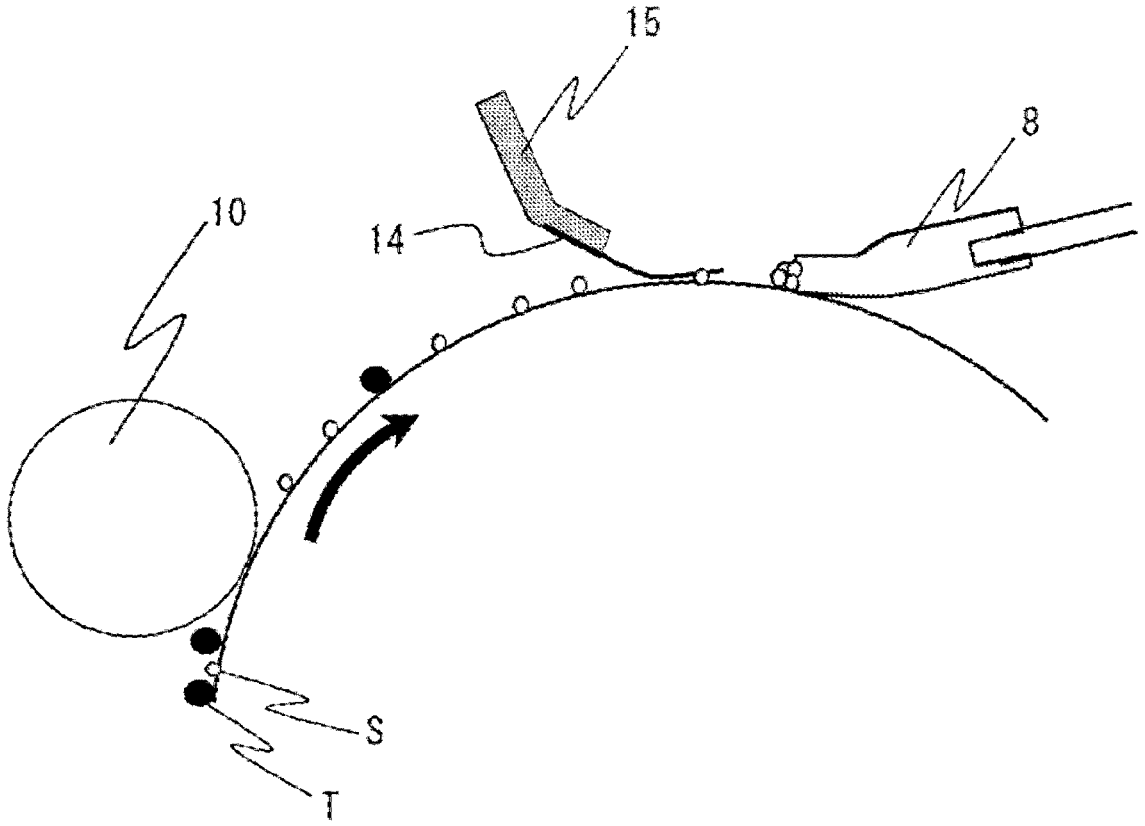
FIG. 7 is an explanatory diagram of the movement of developer and external additive.

FIG. 8 illustrates an enlargement of the nip portion 16 of the recovery sheet member 14 of FIG. 7. Particles of the external additive S of strontium titanate remaining by themselves on the photosensitive drum 1 after transfer in the image forming apparatus 100 move herein towards the downstream side, in the rotation direction of the photosensitive drum 1, in a state of having a positive charge amount. During this movement process, the particles of strontium titanate rub against the recovery sheet member 14 between the transfer member and the cleaning blade 8. As a result of triboelectric charging through rubbing of the particles of strontium titanate against the recovery sheet member 14, the charge amount of the particles increases, and the electrostatic forces of the strontium titanate particles towards the recovery sheet member 14 increase likewise. As a result, the strontium titanate particles pool up at the nip portion 16 of the recovery sheet member 14. The strontium titanate particles pooling at the nip portion 16 are pushed from behind by strontium titanate particles moving along the nip portion 16, pass the nip portion 16, come off the surface of the photosensitive drum 1, are recovered together with the developer, as waste developer, and are accommodated in the recovery container 9. A large charge amount of external additive derived from rubbing against the recovery sheet member 14 may cause a decrease in the supply amount of external additive to the cleaning blade 8, and may result in a weaker cleaning effect.

Comparison Between Example and Conventional Example

In the present example, selected is a combination of materials, i.e. polyphenylene sulfide and strontium titanate, in which the charge amount of the external additive is reduced. For comparison, in a conventional example, a 38 μm sheet having a base material of inexpensive general-purpose PET (polyethylene terephthalate is used as a recovery/prevention sheet.

Material: PET sheet (Toray Industries, Inc.: Lumirror®)
Thickness: 38 μm
Work function: 5.33 eV
Young's modulus: 2000 $N/m^2$
Poisson's ratio: 0.21

Joining to the cleaning frame by laser welding was carried out so that the conditions of contact against the photosensitive drum were as follows.

Free length: 4.5 mm
Penetration level: 2.0 mm
Setting angle θ: 23°

In the present example, for comparison, silicon oxide (20 nm) is used, other than strontium titanate, as the external additive. When used as an external additive, silicon oxide is used for the purpose of enhancing the flowability of the developer, since silicon oxide is charged to so-called negative polarity with respect to the developer.

Rubbing Test

Figure 9A:
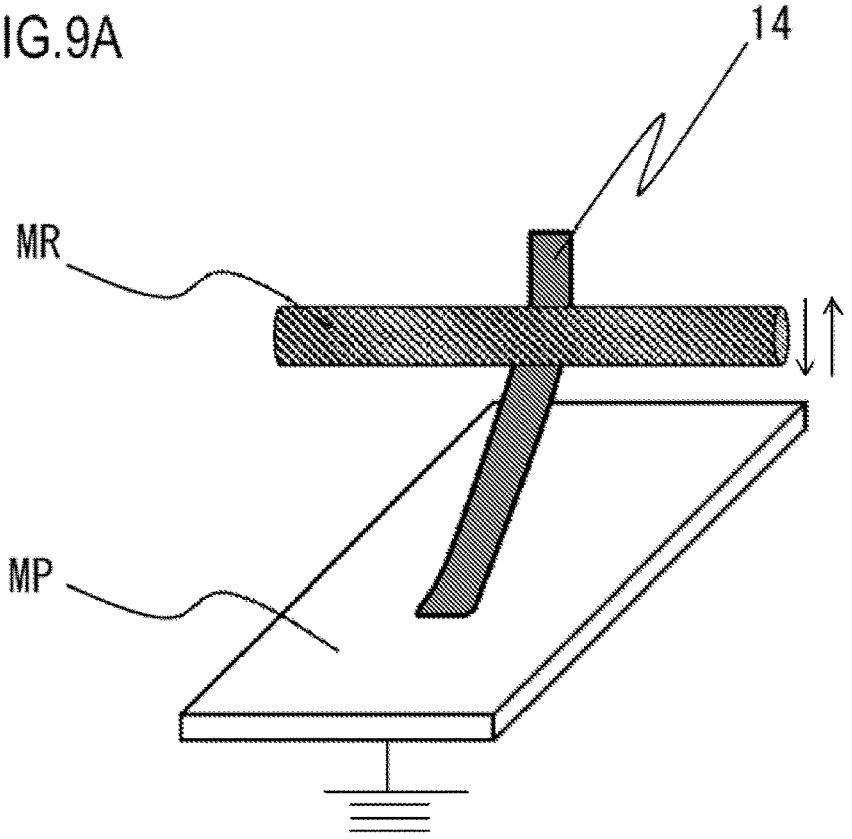
FIG. 9A and FIG. 9B are explanatory diagrams of a rubbing test.
Figure 9B:
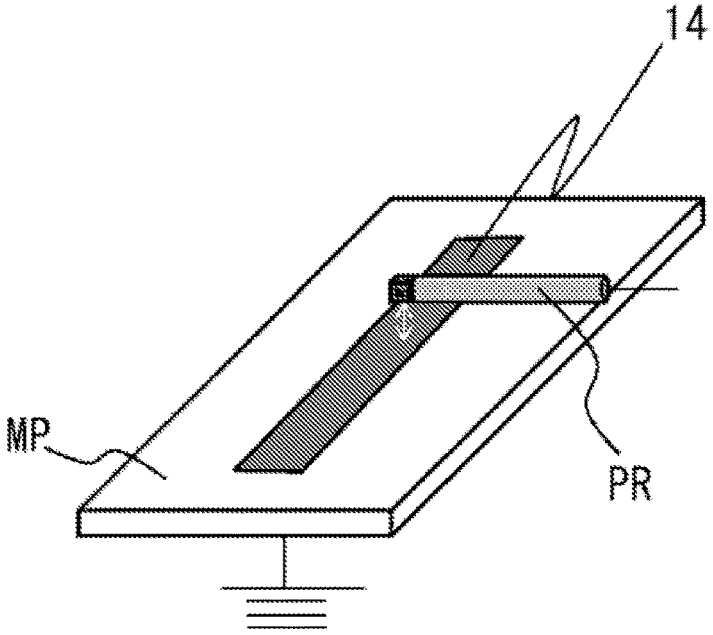

The external additive is difficult to pelletize, and accordingly a rubbing test is used as an alternative method to the work function measurement method described above. In the rubbing test, the triboelectric charging polarity of the external additive is checked directly. In the rubbing test, one end of the recovery sheet member 14 is fixed to a metal plate MP, as illustrated in FIG. 9A. In this case, the recovery sheet member 14 is fixed to the metal plate MP so that the other end of the recovery sheet member 14 is stretched in midair. An insulator adhesive is applied to the surface of a metal roller MR, and the external additive is applied uniformly on the adhesive. The static charge of the recovery sheet member 14 and of the metal roller MR coated with the external additive is eliminated beforehand using for instance an ionizer. Then, the recovery sheet member 14 and the metal roller MR are rubbed 50 times back and forth against each other. Thereafter, the surface potential of the recovery sheet member 14 is measured in a state where the recovery sheet member 14 is fixed to the surface of the metal plate MP, as illustrated in FIG. 9B. For measuring the surface potential of the recovery sheet member 14, a surface potential meter by Trek Inc. (Model 344) is used as a surface potential meter. The length from the tip of a probe PR of the surface potential meter to the surface of the recovery sheet member 14 is set to 1.0 mm.

Figure 10:
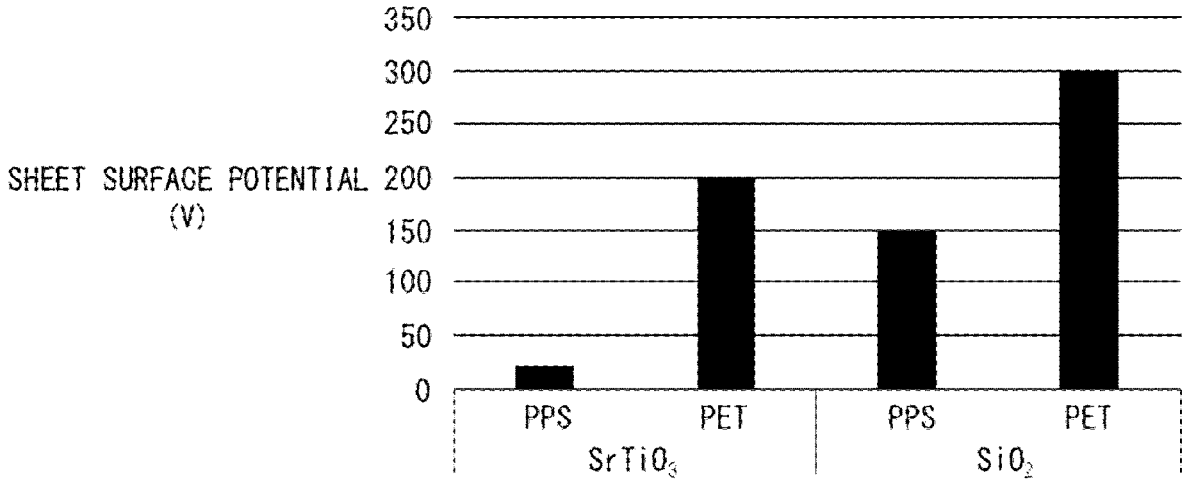
FIG. 10 is a graph of the result of a rubbing test.

FIG. 10 illustrates a measurement result of surface potential of the recovery sheet member 14 measured as described above. In the figure, a measurement result given as a set of "PET" and "$SrTiO_3$" is a measurement result for a configuration with a PET recovery sheet member 14 and a strontium titanate external additive. The surface potential at the point in time where the recovery sheet member 14 and the metal roller MR have been rubbed back and forth 50 times is in that case 200 V. Therefore, the charging potential of the strontium titanate external additive is deemed to be about −200 V. In the figure, a measurement result given as a set of "PPS" and "$SrTiO_3$" is a measurement result for a configuration with a PPS recovery sheet member 14 and a strontium titanate external additive. The surface potential at the point in time where the recovery sheet member 14 and the metal roller MR have been rubbed back and forth 50 times is in that case a potential of 20 V. Therefore, the charging potential of the strontium titanate external additive is deemed to be about −20 V. The above suggests that the position of PPS in the charging series lies is closer to strontium titanate than PET does, and thus charging of strontium titanate is suppressed to a greater extent than in the case of PET.

In the figure, a measurement result given as a set of "PET" and "$SiO_2$" is a measurement result for a configuration with a PET recovery sheet member 14 and a silicon oxide external additive. The surface potential at the point in time where the recovery sheet member 14 and the metal roller MR have been rubbed back and forth 50 times is in that case 300 V. Therefore, the charging potential of the silicon oxide external additive is deemed to be about −300 V. In the figure, a measurement result given as a set of "PPS" and "$SiO_2$" is a measurement result for a configuration with a PPS recovery sheet member 14 and a silicon oxide external additive. The surface potential at the point in time where the recovery sheet member 14 and the metal roller MR have been rubbed back and forth 50 times is in that case a potential of 150 V. Therefore, the charging potential of the silicon oxide external additive is deemed to be about −150 V In the present example, thus the charged amount of the external additive can be curtailed on the basis of a combination of the materials of the external additive and of the recovery sheet member.

An assessment of the work functions of the materials on the basis of the measurement results, from positive polarity to negative polarity, yields the following.

—Positive Polarity—
PET 5.33 eV
PPS 5.88 eV
$SrTiO_3$ about 5.9 eV
Developer 6.03 eV
—Negative Polarity—

Strontium titanate has a polarity close to that of PPS, which in turn is somewhat closer to positive polarity, i.e. strontium titanate is somewhat closer to negative polarity, from among PPS and strontium titanate. Accordingly, the work function of strontium titanate can be estimated as being about 5.9 eV.

In the present example, thus, the work function Φ for which the charged amount of the external additive can be regarded as being a charged amount that lowers the cleaning effect is given by Expression (8) below. Herein $\Phi(SrTiO_3)$ and Φ(PET) represent the work functions of strontium titanate and PET, respectively.

$$|\Phi(SrTiO_3)-\Phi(PET)|=0.57 \quad (8)$$

It is found that the cleaning effect can be made more pronounced than a conventional effect when the difference between the work function of the external additive and the work function of the recovery sheet member lies within a range smaller than the above work function, i.e. when the difference satisfies Expression (9) below.

$$0\ (eV) \leq |\Phi(SrTiO_3)-\Phi(PET)| < 0.57\ (eV) \quad (9)$$

Strontium titanate which is an external additive is charged to positive polarity, with respect to the developer, and accordingly it is found that the relationship given by Expression (10) below is satisfied. Further, Φ(developer) denotes the work function of the developer.

$$\Phi(SrTiO_3)<\Phi(\text{developer}) \quad (10)$$

Measurement of Pooling Amount of External Additive

An explanation follows next on a measurement of the pooling amount of external additive at the tip of the cleaning blade 8, for establishing a target value of the supply amount of the external additive with respect to the developer in the present example. The pooling amount of external additive is measured through output of paper in the image forming apparatus 100 under the same environment as described above, namely a temperature of 23° C. and humidity of 50%. Specifically, an image is used that has an image ratio of 4% resulting from drawing of a plurality of horizontal lines (lines along the axial direction of the rotation axis of the photosensitive drum 1). Then 10 prints are outputted continuously using paper of A4 size, in the image forming apparatus 100, and the nip portion formed between the cleaning blade 8 and the photosensitive drum 1 is observed. The pooling portion of external additive to be measured is covered with developer, and hence the nip portion is observed after the developer has been blown away through air blowing. The pooling amount of the external additive is calculated as the product of the height (μm) and the width (μm) of the pooling portion of the external additive.

Figure 1:
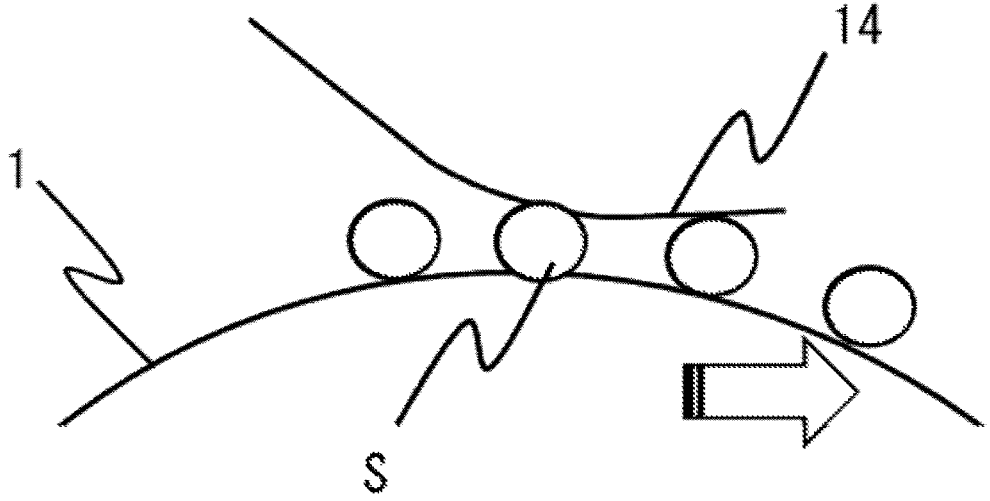
FIG. 1 is a cross-sectional diagram of spherical strontium titanate and a recovery sheet member according to Examples 1 and 2.
Figure 11:
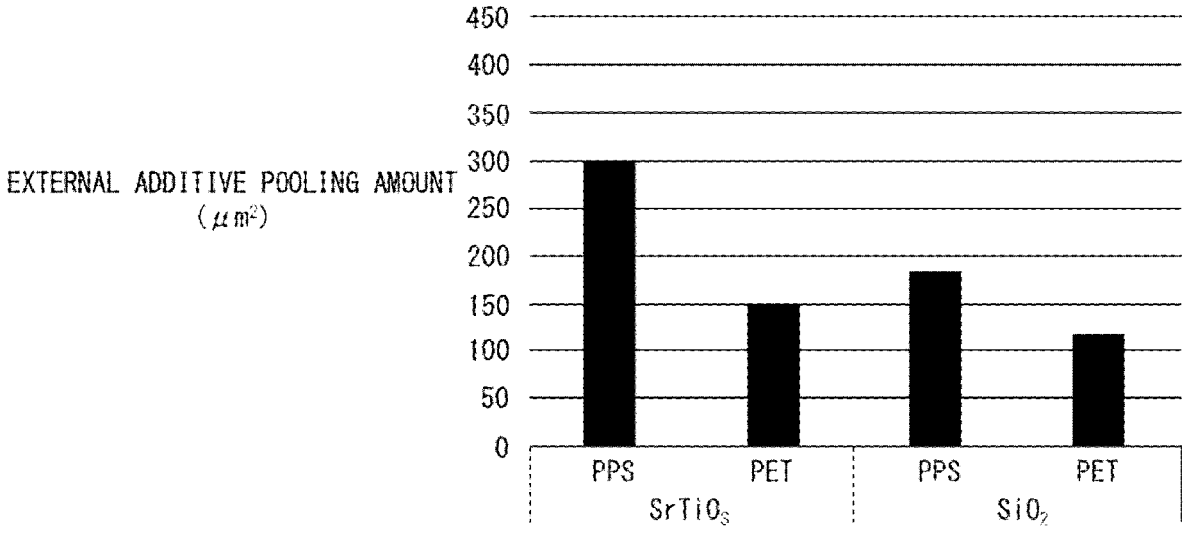
FIG. 11 is a graph of a result of pooling amount of external additive.

FIG. 11 illustrates a measurement result of the pooling amount of the external additive calculated on the basis of the above observation. FIG. 11 reveals that from among the combinations of materials of the recovery sheet member, namely PET and PSS, and the materials of the external additive, namely strontium titanate and silicon oxide, the pooling amount of external additive for the combination of PSS and strontium titanate is greater than those for other combinations. The underlying reason for this will be explained with reference to FIG. 1. As illustrated in FIG. 1, external additive particles (denoted as "S" in the figure) are charged through rubbing with the recovery sheet member 14, at the nip portion formed between the photosensitive drum 1 and the recovery sheet member 14. The increase in charged amount of the external additive can be suppressed to a greater extent in a combination of a PPS recovery sheet member 14 and a strontium titanate external additive than in the other combinations above. When the charged amount of the external additive is reduced, also the electrostatic adhesion force of the external additive towards the recovery sheet member 14 becomes weaker. It is found that, as a result, the external additive pools readily up at the nip portion between the cleaning blade 8 and the photosensitive drum 1, without continuing to adhere to the recovery sheet member 14.

Evaluation of Cleaning Effect

In order to verify the cleaning effect elicited by the above configuration of the present example, prints are outputted in the image forming apparatus 100 in an environment at a temperature of 23° C. and humidity of 50%, as in the measurement of the pooling amount of external additive above. Specifically, an image is used that has an image ratio of 4% resulting from drawing of a plurality of horizontal lines (lines along the axial direction of the rotation axis of the photosensitive drum 1). Then 3000 prints are outputted continuously using paper of A4 size, in the image forming apparatus 100, and it is observed whether faulty cleaning is evident or not on the 3000 prints. Faulty cleaning denotes herein a state in which thick vertical streaks ordinarily deemed as unacceptable by the user of the image forming apparatus 100 are formed on paper. Observation results are given in Table 1. In the table, "Yes" signifies that vertical streaks are observed on the paper, and "No" signifies that no vertical streaks are observed on the paper.

TABLE 1

| Material of recovery sheet member | Faulty cleaning |
|---|---|
| PPS | No |
| PET | Yes |

As a result, it is found that a better cleaning effect is obtained by adopting a configuration in which the PPS recovery sheet member 14 and the strontium titanate external additive of the present example are used, as compared with conventional configurations.

In the explanation above, the thickness of the recovery sheet member 14 is envisaged to be 38 μm, but the thickness of the recovery sheet member 14 is not limited thereto. The thickness of the recovery sheet member 14 and the length L2 of the free length may be respectively set to a thickness of 10 m to 100 m and a "free length" of 3.39 mm to 4.79 mm, which are values envisaged for a general-purpose recovery sheet member. In a case where the thickness of the recovery sheet member 14 is from 10 m to 100 μm and the length L2 of the free length of the recovery sheet member 14 is from 3.39 mm to 4.79 mm, then the length L of the nip portion 16 is from 10 m to 1000 μm, and the contact pressure is from $8.24\times10-6$ N/mm to $3.05\times10^{-2}$ N/mm. It has been found that an effect similar to the one above is obtained also in a case where the recovery sheet member 14 is configured so as to satisfy such conditions.

In the above explanation, the number-average particle diameter of the primary particles of strontium titanate which is the external additive is assumed to be about 100 nm, but the number-average particle diameter is not limited thereto, and it was found that an effect similar to that above is obtained also in a case where the number-average particle diameter of the primary particles of strontium titanate used as the external additive is set to 50 nm to 300 nm.

Example 2

Example 2 of the present invention will be explained next. In Example 2, constituent elements identical to those of Example 1 will be denoted with the same reference symbols, and a detailed explanation thereof will be omitted. In the present example a material different from the material of Example 1 is used as the material of the recovery sheet member 14. Specifically, PTFE (polytetrafluoroethylene) (Teflon (registered trademark)) is used as the material of the recovery sheet member 14. The characteristics of the PTFE recovery sheet member 14 in the present example are as follows.

Thickness: 38 μm
Work function: 6.0 eV
Young's modulus: 560 N/m$^2$
Poisson's ratio: 0.46

The recovery sheet member 14 is joined to the cleaning frame 15 so that the recovery sheet member 14 comes into contact with the photosensitive drum 1 while satisfying the conditions below.

Free length: 4.5 mm
Penetration level: 2.0 mm
Setting angle θ: 23°

In a case where the recovery sheet member 14 is configured on the basis of the above conditions, the length of the nip portion 16 formed through contact of the recovery sheet member 14 with the photosensitive drum 1, i.e. the length over which the recovery sheet member 14 comes into contact with the photosensitive drum 1, in the rotation direction of the photosensitive drum 1, is 300 μm. The contact pressure on the photosensitive drum 1 by the recovery sheet member 14 is $4.02\times10^{-4}$ N/mm.

Rubbing Test

Figure 12:
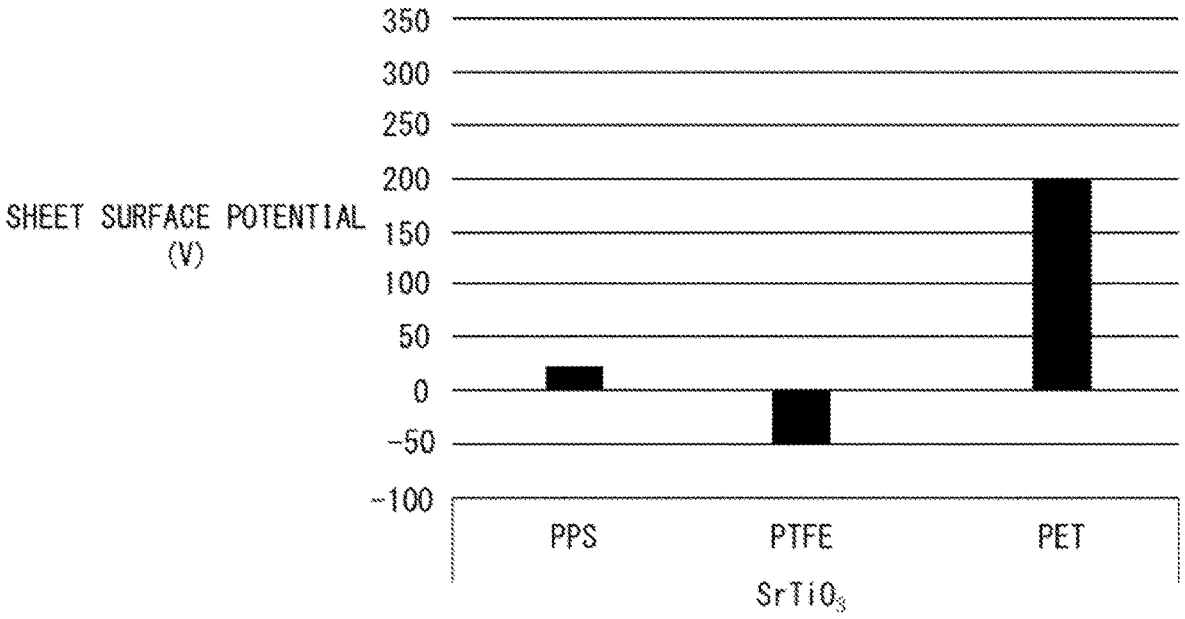
FIG. 12 is a graph of the result of a rubbing test.

A rubbing test identical to that of Example 1 is performed on the recovery sheet member 14 of the present example. FIG. 12 illustrates the result of the rubbing test of the recovery sheet member 14 of the present example. In the figure, a measurement result given as a set of "PTFE" and "$SrTiO_3$" is a measurement result for a configuration with a PTFE recovery sheet member 14 and a strontium titanate external additive. In that case, the surface potential at the point in time where the recovery sheet member 14 and the metal roller MR have been rubbed back and forth 50 times is −50 V. Therefore, the charging potential of the strontium titanate external additive is deemed to be about 50 V. As illustrated in Example 1, the measurement result of the recovery sheet member 14 in a configuration with a PET recovery sheet member 14 and strontium titanate external additive yields a surface potential of 200 V at the point in time where the recovery sheet member 14 and the metal roller MR have been rubbed back and forth 50 times. It is found in consequence that, as an absolute value of the surface potential of the recovery sheet member 14, the surface potential of a PTFE recovery sheet member 14 is smaller, i.e. triboelectric chargeability is lower, than the surface potential of a PET recovery sheet member 14. From the above it is deemed that the polarities of PET, strontium titanate, PTFE and developer based on work functions are as follows.

—Positive Polarity—

PET 5.33 eV $SrTiO_3$ about 5.9 eV

PTFE 6.0 eV

Developer 6.03 eV

—Negative Polarity—

In the present example as well, as in Example 1, the work function Φ for which the charged amount of the external additive can be regarded as being a charged amount that lowers the cleaning effect is thus given by Expression (11) below.

$$|\Phi(SrTiO_3)-\Phi(PET)|=0.57 \quad (11)$$

It is found that the cleaning effect can be made more pronounced than a conventional effect, when the difference between the work function of the external additive and the work function of the recovery sheet member 14 lies within a range smaller than the above work function, i.e. when the difference satisfies Expression (12) below.

$$0\ (eV)\leq|\Phi(SrTiO_3)-\Phi(PET)|<0.57\ (eV) \quad (12)$$

Strontium titanate which is the external additive is charged to positive polarity, with respect to the developer, and accordingly it is found that the relationship given by Expression (13) below is satisfied.

$$\Phi(SrTiO_3)<\Phi(developer) \quad (13)$$

Measurement of Pooling Amount of External Additive

Figure 13:
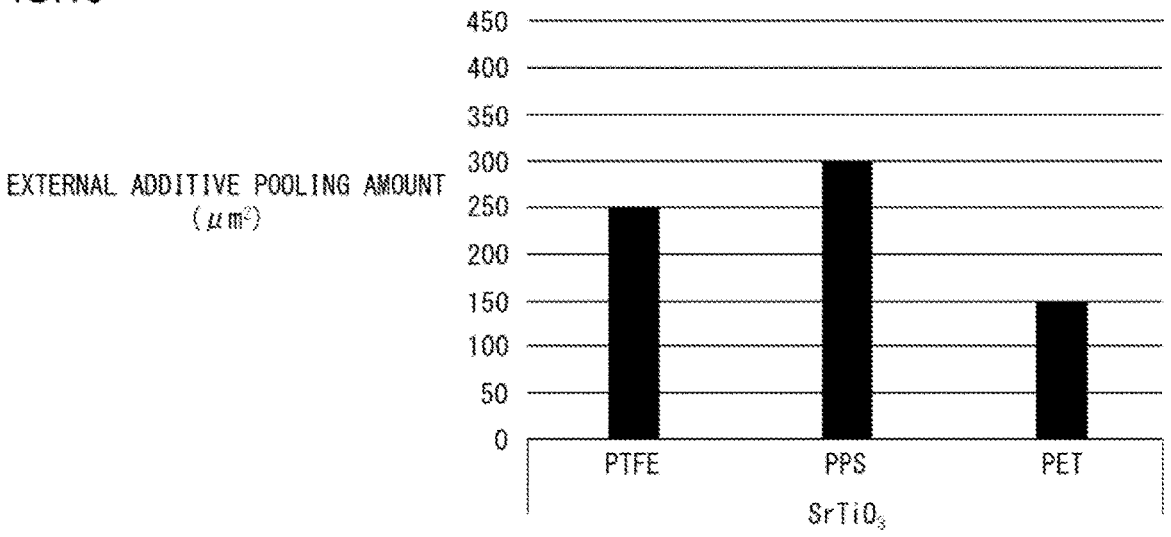
FIG. 13 is another graph of a result of pooling amount of external additive.

Similarly to Example 1, FIG. 13 illustrates the result of a measurement of the pooling amount of external additive in the present example. As illustrated in FIG. 13, the pooling amount of the external additive in a combination of PTFE and strontium titanate is close to the pooling amount of an instance where the material of the recovery sheet member 14 is PPS, and larger than that when the material of the recovery sheet member 14 is PET. The underlying reasons for this are the same as in Example 1. Specifically, the increase in charged amount of the external additive can be further suppressed in a combination of a PTFE recovery sheet member 14 and a strontium titanate external additive, from in a combination of a PET recovery sheet member 14 and a strontium titanate external additive. When the charged amount of the external additive is reduced, also the electrostatic adhesion force of the external additive towards the recovery sheet member becomes weaker. It is found that, as a result, the external additive pools readily up at the nip portion between the cleaning blade 8 and the photosensitive drum 1, without continuing to adhere to the recovery sheet member 14.

Evaluation of Cleaning Effect

The cleaning effect elicited by the above configuration of the present example was checked in the same way as in Example 1. The observation results are given in Table 2.

TABLE 2

| Material of recovery sheet member | Faulty cleaning |
|---|---|
| PTFE | No |
| PET | Yes |

As compared with conventional configurations, it is therefore found that, similarly to Example 1, a better cleaning effect is obtained by adopting a configuration in which the PTFE recovery sheet member 14 and the strontium titanate external additive of the present example are used.

Example 3

In the present example the cleaning effect elicited by external additives of various particle shapes is assessed for a case where the particle shape of a strontium titanate external additive is modified.

In the above example, the particle shape of the strontium titanate external additive is spherical. In the present example an instance is envisaged where the particle shape of the strontium titanate external additive has a rectangular parallelepiped shape. As an example of a rectangular parallelepiped shape, in the explanation below a strontium titanate external additive having a cubic shape with a 100 nm side is externally added in the same addition amount as the external additive in the above examples.

Measurement of Pooling Amount of External Additive

Figure 14:
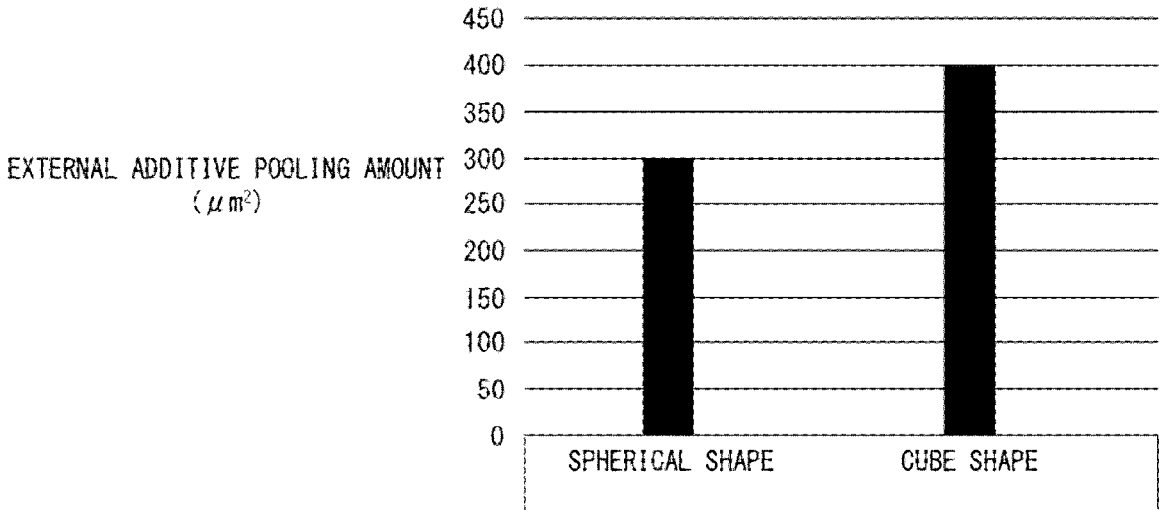
FIG. 14 is yet another graph of a result of pooling amount of external additive.

The pooling amount of the external additive at the tip of the cleaning blade 8 in the present example is measured in the same way as in Examples 1 and 2. FIG. 14 illustrates the measurement result of pooling amount of external additive. As illustrated in FIG. 14, in the case of a strontium titanate external additive of cubic shape the pooling amount at the tip of the cleaning blade 8 is larger than that of a strontium titanate external additive of spherical shape.

Figure 15:
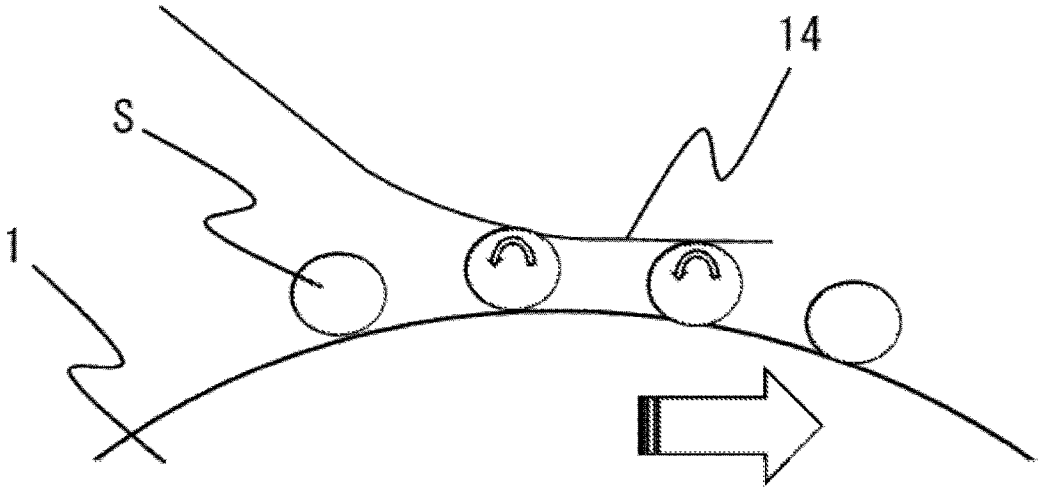
FIG. 15 is a cross-sectional diagram of strontium titanate and a recovery sheet member according to Example 3.
Figure 16:
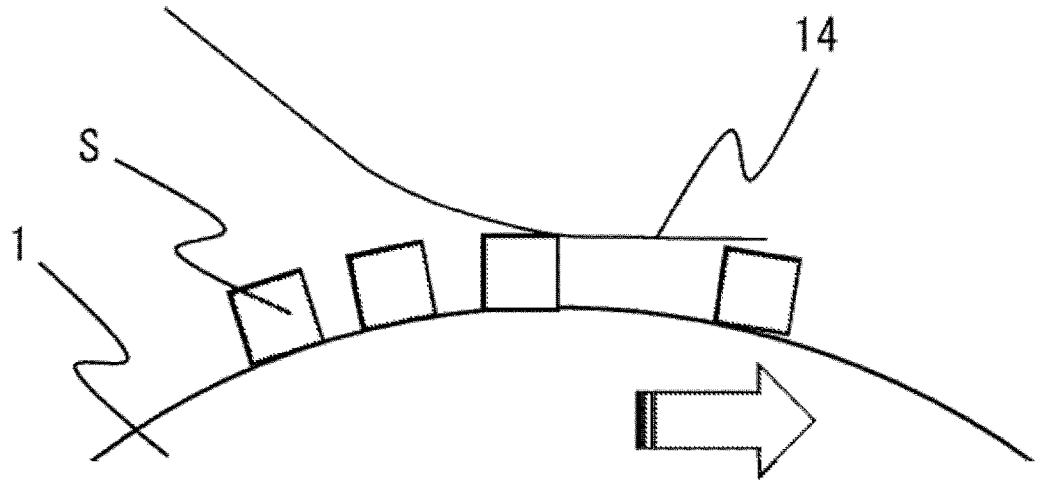
FIG. 16 is another cross-sectional diagram of strontium titanate and a recovery sheet member according to Example 3.

The measurement results of the pooling amount will be explained with reference to FIG. 15 and FIG. 16. FIG. 15 and FIG. 16 illustrate schematically, similarly to FIG. 1, charging of external additive particles ("S" in the figure) through rubbing with the recovery sheet member 14, at the nip portion formed between the photosensitive drum 1 and the recovery sheet member 14. FIG. 15 illustrates an instance where the particle shape of the strontium titanate external additive is spherical. FIG. 16 illustrates an instance where the particle shape of the strontium titanate external additive is cubic.

The external additive particles rotate, by being acted upon by a pressing force from the photosensitive drum 1 and the recovery sheet member 14, at the nip portion between the photosensitive drum 1 and the recovery sheet member 14. It is found that the external additive particles of spherical shape tend to rotate more readily at the nip portion, from among instances of the spherical external additive illustrated in FIG. 15 and the cubic external additive illustrated in FIG. 16. Specifically, it is deemed that the variability in the rotation amount of the particles of the external additive at the nip portion is larger in the case of external additive particles of spherical shape. Accordingly, it is deemed that also the variability in the amount of displacement of the particles of the external additive in the rotation direction of the photosensitive drum 1, accompanying rotation of the photosensitive drum 1, is larger in the case of external additive particles of spherical shape. It is found that the smaller the displacement amount of the external additive in the rotation direction of the photosensitive drum 1, accompanying the rotation of the photosensitive drum 1, the less readily the external additive particles reach the cleaning blade 8. Therefore, it is deemed that a cubic external additive exhibiting less variability in the above displacement amount is supplied in a greater amount, than a spherical external additive, to the nip portion between the cleaning blade 8 and the photosensitive drum 1.

Evaluation of Cleaning Effect

Table 3 sets out the results of cleaning effect elicited by the above configuration of the present example, verified in the same way as in Examples 1 and 2. The term "No" pertaining to faulty cleaning in the table has the same meaning as in Tables 1 and 2, while the term "Minor" denotes a state in which thin vertical streaks, ordinarily deemed as acceptable by the user of the image forming apparatus 100, are formed on paper.

TABLE 3

| Enviroment conditions | External additive shape | Faulty cleaning |
|---|---|---|
| 23° C. 50% | Spherical $SrTiO_3$ | No |
| | Cubic $SrTiO_3$ | No |
| 0° C. | Spherical $SrTiO_3$ | Minor |
| | Cubic $SrTiO_3$ | No |

Table 3 shows that no vertical streaks attributable to faulty cleaning are visible on the outputted paper, both when the shape of the external additive is spherical and when the shape is cubic, in an environment at a temperature of 23° C. and humidity of 50%. Therefore, in order to verify the cleaning effect in further detail, prints are outputted in an environment at a temperature of 0° C., and in an environment at a temperature of 23° C. and humidity of 50%, and the occurrence or absence of faulty cleaning is checked. It is known that the lower the temperature of the operation environment, the lower is the elasticity of the cleaning blade 8, which results in a poorer cleaning effect. Table 3 shows that, in an environment at a temperature of 0° C., slightly faulty cleaning occurs in a configuration where a spherical strontium titanate external additive is used, while still no faulty cleaning occurs in a configuration where a cubic strontium titanate external additive is used. In the case where a strontium titanate external additive is used, therefore, it is found that a better cleaning effect is achieved by using an external additive of cubic shape.

The present invention allows maintaining cleaning performance, while curtailing the amount of external additive that is used, by increasing the efficiency of supply of the external additive to the nip portion. By keeping thus small the amount of external additive, moreover, it becomes possible to achieve a lower melting point of the toner (developer), and to suppress consumption of energy in the fixing step of the image forming operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-240047, filed on Dec. 21, 2018, which is hereby incorporated by reference herein in its entirety.

What is claimed is:

1. A cleaning device, comprising:

a cleaning frame;

a cleaning member having one end attached to the cleaning frame and the other end that is a free end, the cleaning member coming into contact with an image bearing member so as to remove developer remaining on the image bearing member after transfer of a developer image from the image bearing member, the image bearing member being capable of rotating and bearing a developer image which is formed of a developer containing an external additive; and a sheet member having flexibility, and having one end attached to the cleaning frame and the other end that comes into contact with the image bearing member at an upstream side of a contact position between the cleaning member and the image bearing member in the rotation direction of the image bearing member, wherein the external additive is an inorganic salt having a charging polarity on the positive side with respect to the developer; and wherein a work function Φ(S) of the sheet member, a work function Φ(A) of the external additive and a work function Φ(T) of the developer satisfy Expressions (1) and (2):

$$0\ (\text{eV}) \leq |\Phi(A)-\Phi(S)| < 0.57\ (\text{eV}) \quad (1)$$

$$\Phi(A) < \Phi(T) \quad (2).$$

2. The cleaning device of claim 1, wherein a direction in which the sheet member extends from the one end toward the other end is substantially identical to the rotation direction of the image bearing member at a region at which the other end comes into contact with the image bearing member.

3. The cleaning device of claim 1, wherein a range of contact pressure of the sheet member on the image bearing member is from $8.24\times10^{-6}$ N/mm to $3.05\times10^{-2}$ N/mm; and wherein, in the rotation direction of the image bearing member, a range of the width of a nip portion formed by the cleaning member and the image bearing member, is from 10 μm to 1000 μm.

4. The cleaning device of claim 1, wherein a base material of the sheet member is polyphenylene sulfide (PPS).

5. The cleaning device of claim 1, wherein a base material of the sheet member is polytetrafluoroethylene (PTFE).

6. The cleaning device of claim 1, wherein the external additive includes particle of strontium titanate.

7. The cleaning device of claim 1, wherein the particle of the external additive has a rectangular parallelepiped shape.

8. The cleaning device of claim 7, wherein a range of number-average particle diameter of primary particle of the external additive is from 50 nm to 300 nm.

9. A process cartridge, comprising:

an image bearing member capable of rotating and bearing a developer image which is formed of a developer containing an external additive;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member; and a sheet member having flexibility, and having one end attached to the cleaning frame and the other end that comes into contact with the image bearing member at an upstream side of a contact position between the cleaning member and the image bearing member in the rotation direction of the image bearing member, wherein the external additive is an inorganic salt having a charging polarity on the positive side with respect to the developer; and wherein a work function Φ(S) of the sheet member, a work function Φ(A) of the external additive and a work function Φ(T) of the developer satisfy Expressions (3) and (4):

$$0\ (\mathrm{eV}) \leq |\Phi(A)-\Phi(S)| < 0.57\ (\mathrm{eV}) \quad (3)$$

$$\Phi(A) < \Phi(T) \quad (4).$$

10. An image forming apparatus, comprising:

an image bearing member capable of rotating and bearing a developer image which is formed of a developer containing an external additive;

a transfer member that transfers the developer image borne on the image bearing member to a transferring material;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member; and a sheet member having flexibility, and having one end attached to the cleaning frame and the other end that comes into contact with the image bearing member at an upstream side of a contact position between the cleaning member and the image bearing member in the rotation direction of the image bearing member, wherein the external additive is an inorganic salt having a charging polarity on the positive side with respect to the developer;

and wherein a work function Φ(S) of the sheet member, a work function Φ(A) of the external additive and a work function Φ(T) of the developer satisfy Expressions (5) and (6):

$$0\ (\mathrm{eV}) \geq |\Phi(A)-\Phi(S)| < 0.57\ (\mathrm{eV}) \quad (5)$$

$$\Phi(A) < \Phi(T) \quad (6).$$

* * * * *